United States Patent [19]

MacBean

[11] 4,379,735

[45] Apr. 12, 1983

[54] THREE-LAYER FORMING FABRIC

[75] Inventor: Donald G. MacBean, Ottawa, Canada

[73] Assignee: JWI Ltd., Kanata, Canada

[21] Appl. No.: 290,797

[22] Filed: Aug. 6, 1981

[51] Int. Cl.[3] ..... D21F 1/10

[52] U.S. Cl. ..... 162/348; 162/301; 139/411; 139/425 A; 428/258

[58] Field of Search ..... 162/300, 301, 348; 139/411, 412, 425 A; 428/258

[56] References Cited

U.S. PATENT DOCUMENTS

| | | | |
|---|---|---|---|
| 2,866,483 | 12/1958 | Watts et al. | 139/412 |
| 3,996,098 | 12/1976 | Kankaanpaa | 162/301 X |
| 4,196,248 | 4/1980 | Dutt | 428/258 X |
| 4,274,448 | 6/1981 | Westhead | 139/412 X |

*Primary Examiner*—Richard V. Fisher

*Attorney, Agent, or Firm*—Oblon, Fisher, Spivak, McClelland & Maier

[57] ABSTRACT

A single ply forming fabric for use on a twin wire paper making machine wherein a flat jet stream of pulp is injected between an inner, conveying fabric and an outer, backing fabric converging towards each other for applying opposed pressure to the pulp for removing water therefrom to form a sheet of pulp. The single ply forming fabric of the present invention constitutes the outer, backing fabric and is interwoven with a plurality of monofilament polymeric warp strands with approximately 100% warp fill and monofilament polymeric weft strands extending in the cross-machine direction and disposed in vertically aligned groups of at least three to obtain greater stiffness in the cross-machine direction whereby to substantially redistribute pulp widthwise of the sheet when supported on the conveying fabric.

6 Claims, 8 Drawing Figures

P
10
11
12
13
14
15
16
17
18
19
20
21
22
23
23'
24
25
28
30

THREE-LAYER FORMING FABRIC

BACKGROUND OF INVENTION (a) Field of Invention

This invention relates to forming fabrics and particularly to those used on twin-wire paper making machines.

(b) Description of Prior Art

There are several known types of twin-wire formers all involving the injection of a stream of pulp usually containing over 99% water, into a converging gap formed by two separate endless fabrics, or wires, as they have been called, moving in the same direction and at the same speed. The gap is arranged to converge until the fabrics run together in a dewatering section with the layer of pulp sandwiched between them. The pulp is squeezed as the sandwich is drawn over a cylindrical roll or a curved stationary shoe or a series of deflector blades set in an arcuate configuration to provide support for the inner or conveying fabric while the outer or backing fabric converges forcing water out of the pulp while the fibers of the pulp remain substantially frozen in position.

Because of their greater speed capability and requiring less space and less energy, twin-wire forming machines have been gaining in popularity in recent years. However, due to a persistent tendency to produce paper having a streaky appearance, the use of twin wire formers has been limited to the production of certain grades of paper in which these quality defects are not of critical importance.

Streakiness in paper formed on a twin wire machine is generally caused by uneven disposition of pulp fibers and this has invariably been attributed to machine conditions such as incorrect setting of machine components related to the head box or slice jet or to improper setting of shoes or deflector blades in the dewatering section of the machine.

It has now been found that a cause of streakiness is unequal thickness of the sheet-like jet stream of pulp stock that is injected into the wedge-shaped converging gap between the two fabrics before they pass over the cylindrical roll or arcuate shoe. The thickness variations tend to deflect the outer backing fabric into shallow wrinkles or gullies disposed in the running direction of the machine. A gully that separates the fabrics will tend to hold a higher concentration of fibers in that area which will result in a more opaque streak in the paper. There will be a correspondingly lower concentration of pulp fibers in the areas adjacent to the gully, which results in a less opaque streak in the paper thus exaggerating the condition.

A factor that influences uneven constitution of the jet stream of pulp is that the distance of travel of the jet from the slice outlet to the point of impingement on one or other of the fabrics is necessarily quite long, in the order of about 40 cm or more on some machines and at least 25 cm on most small machines. Before this distance from the slice outlet is reached, the ribbon-like jet has lost its smooth character on both surfaces and begins to to have a corrugated appearance of an irregular character. These corrugations, which extend in the machine direction, appear as thickness variations in the cross-machine direction, and may be caused by minor defects in the slice lips, by the adherence of pulp stock or foreign objects or even by turbulence in the head box itself. However, no matter if the slice is virtually perfect in manufacture and is maintained in perfect condition, the jet stream will invariably become irregular within a distance of about 25 cm or less. Any defects such as those mentioned above simply worsen the condition.

It has further been found that if the cross-machine stiffness of the outer fabric of certain twin wire formers is increased, so that the tendency of this fabric to form gullies is reduced, inequalities in the thickness of the jet stream of pulp will also be reduced or eliminated (ironed out) and a more uniform concentration of pulp fibers throughout will result.

Forming wires were, until fairly recently, woven with bronze warp wires and brass or bronze weft wires. The metal cloth was woven in a semi-twill single layer pattern. It was inherently stiff in the cross-machine direction and provided good pulp support because of the fineness of the mesh, making the cloth particularly well suited for use, for example, on a Bel Baie II paper forming machine. From a practical point of view it is most desirable to use forming fabrics made of woven plastic polymeric strands because of their greater flexibility and better wear and corrosion resistance. However, a disadvantage of conventional plastic fabrics, and one which limits their suitability for use on twin wire paper making machines, is that due to the natural flexibility of the plastic cross-machine strands, the fabric is prone to form into wrinkles extending in the machine direction. This condition will generally be exaggerated by the high tension under which fabrics normally are run on the twin wire forming machine as well as by thickness variations in the jet-stream as previously explained.

From the above it will be apparent that it would be advantageous to provide a plastic forming fabric having increased stiffness in the cross-machine direction. While this can be accomplished to a certain extent in conventional fabrics by increasing the size and number of cross-machine strands, this measure is not entirely satisfactory because it results in a loss in drainage capacity.

SUMMARY OF INVENTION

The present invention provides a means of overcoming the above-mentioned disadvantage by providing a plastic polymeric monofilament fabric with high stiffness in the cross-machine direction so as to resist deflection by the jet stream of pulp stock while, at the same time, maintaining good drainage and fiber support characteristics. The fabric of the invention comprises a plurality of monofilament polymeric warp strands interwoven, in single-ply construction, with three layers of monofilament polymeric weft strands and having a weft count, in the pulp contacting surface, greater than about 40 per inch.

The fabric, in one embodiment of the invention, has a stiffness value in the cross-machine direction, measured with a Gurley Stiffness Tester, of greater than 15 grams. The weft strands are disposed in vertically aligned groups of three and the upper layer, that which is in closest proximity to the pulp web, has a strand count ranging from 40 to 60 per inch. This fabric provides needed stiffness in the cross-machine direction, good fiber support and adequate drainage.

The Gurley Stiffness Tester is well known in the art and has been utilized in the known manner to assess and compare stiffness of the fabric of the invention with conventional fabric. In laboratory tests with this instrument samples of conventional two-layer synthetic fabric and conventional single layer metal cloth were compared with samples of three layer fabrics of the invention. Representative results of a comparison test are given in Table A, below, in which the sample sizes were 1½ inches long and 1 inch wide.

TABLE A

| | 7 SHED FABRIC | | 8 SHED FABRIC | | 3-SHED BRONZE WIRE CLOTH |
|---|---|---|---|---|---|
| | 2 Layer | 3 Layer | 2 Layer | 3 Layer | Semi-twill |
| MESH | 146 × 91 | 146 × 159 | 182 × 136 | 180 × 174 | 68 × 54 |
| WARP DIA. (Ins.) | 0.0067 | 0.0067 | 0.0055 | 0.0055 | 0.0082 |
| WEFT DIA. (Ins.) | 0.0086 | 0.0086 | 0.0070 | 0.0070 | 0.0095 |
| STIFFNESS WEFT Dir. (GMS) | 8.1 | 26.7 | 5.6 | 13.8 | 22.4 |
| AIR PERMEABILITY (Cu.ft./sq.ft/min) | 488 | 450 | 235 | 625 | 860 |

It will be seen from Table A that these particular three layer synthetic fabrics are two to three times stiffer in the cross-machine direction than conventional two layer synthetic fabrics having the same size warp and weft strands. Further, in comparing them with semitwill single layer bronze cloth, which would provide equivalent fiber support, they are seen to have approximately the same stiffness values as the metal cloth. Other three layer synthetic fabrics, suitable for use on twin wire paper making machines, had cross-machine stiffness values in the 20 to 25 gram range and the preferred ones up to 30 grams.

A characteristic of the fabric of the invention is that each warp strand interweaves with all three layers of weft strands and extends in the machine direction. The weft is in vertically aligned groups of three.

A further characteristic is that warp fill is normally 100%. Warp fill is defined as the amount of warp in a given space relative to the total space considered. For example, 60% warp fill means 60% of the space in the weft direction is taken up by the warp, it being assumed that the warp is aligned horizontally in one plane. It is possible to have greater than 100% warp fill because of overlapping which occurs between warp strands particularly when interwoven with two or more layers of weft. The three layer fabrics of this invention have warp fill in the range of 70% to 130%.

The main feature of the fabric of the invention is that it has improved resistance to bending in the cross-machine direction.

A further feature is that the surface of the fabric, upon which the paper is formed, may be woven in a mesh pattern that provides adequate fiber support without restricting drainage.

The drainage of the fabric is assessed and compared with a Frasier Air Permeometer. This instrument is also well known in the art and is conventionally used to measure the air permeability of fabric which is expressed by the number of cubic feet of air per minute passing through a square foot of the fabric when the pressure drop across it is 0.5 inches of water. The instrument uses a 1 square inch test section of fabric and is calibrated so that a manometer reading applied to a reference graph is converted to cubic feet of air per minute per square foot of fabric.

A still further feature of the fabric of the invention is that it is well adapted for use on a twin wire paper making machine and, particularly, when run at the outer or backing fabric position, its greater stiffness property reduces the incidence of streakiness in the paper produced on this type of machine.

According to a broad aspect of the present invention there is provided a single-ply forming fabric comprising an endless belt having opposed side edges. The forming fabric has a lateral direction extending between the side edges thereof and a longitudinal direction extending perpendicular to the lateral direction. The forming fabric is a backing fabric for use in combination with a conveying fabric with which it converges on a twin-wire paper making machine wherein a flat-jet stream of pulp is injected between the converging backing and conveying fabrics for applying opposed pressure to the pulp for removing water therefrom to form a sheet of paper. The single-ply forming fabric has a plurality of monofilament polymeric warp strands extending in the longitudinal direction and interwoven, with approximately 100% warp fill, with monofilament polymeric weft strands extending in the lateral direction. The weft strands are disposed in vertically aligned groups of at least three to obtain greater stiffness in the lateral direction whereby to substantially re-distribute pulp laterally when it is sandwiched between the fabrics.

BRIEF DESCRIPTION OF DRAWINGS

Preferred embodiments of the present invention will now be described with reference to the examples illustrated in the accompanying drawings in which.

DESCRIPTION OF PREFERRED EMBODIMENTS

Figures 1, 2:
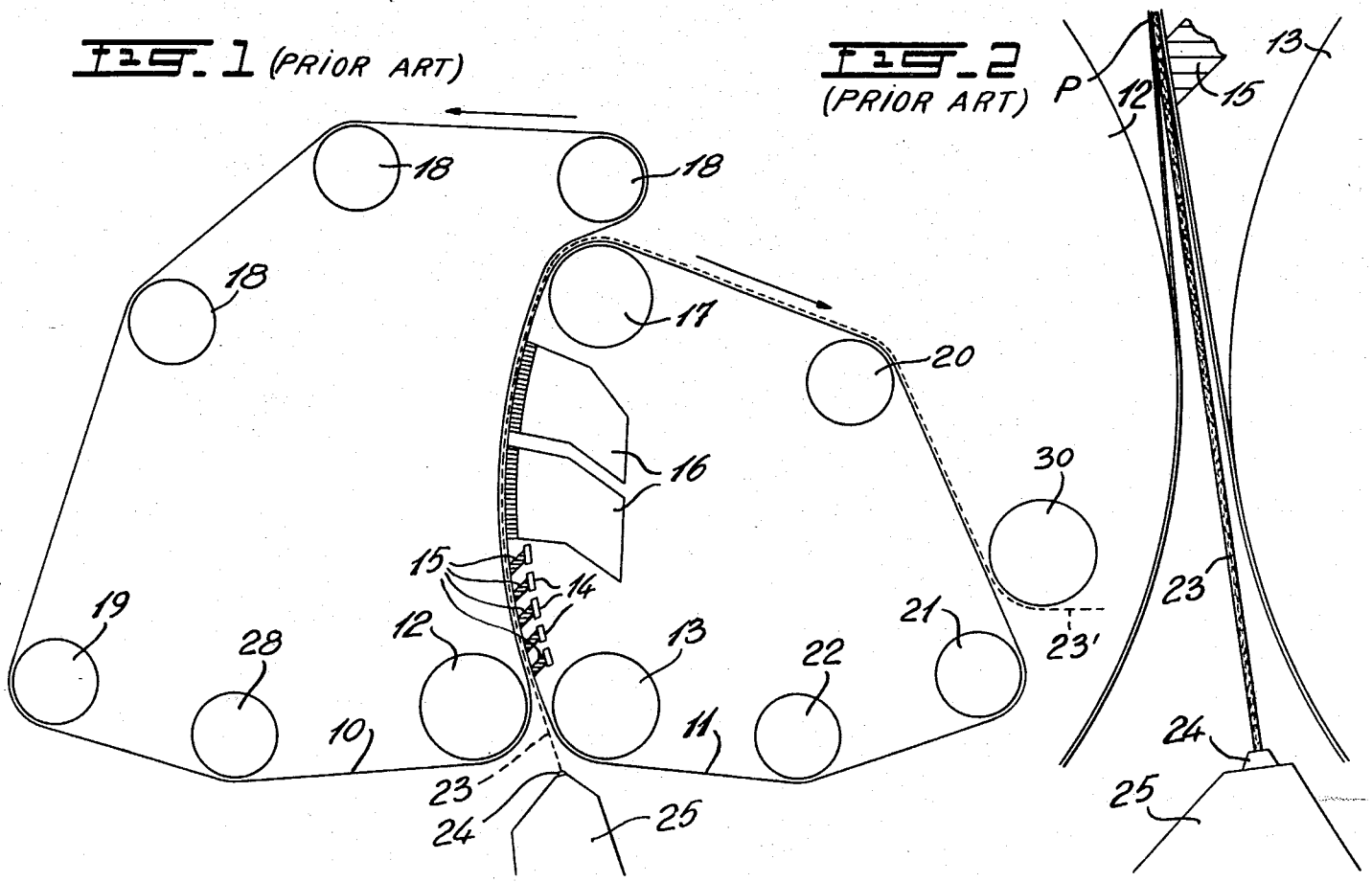
FIG. 2 (PRIOR ART)
FIG. 1 (PRIOR ART)
FIG. 1 is a simplified schematic view of a Bel Baie II paper former upon which the fabric of the invention provides improved performance.
FIG. 2 is an enlarged schematic view of the jet stream area of FIG. 1.

Referring to FIG. 1 the basic elements of a twin wire forming machine are shown including the two forming fabrics or wires, outer wire 10 and inner wire 11 which, guided by forming roll 12 and breast roll 13, converge and travel together, in the direction shown by the arrows, across the curved shoe structure 14 which supports deflector blades 15 in an arcuate path. The forming wires then pass over suction boxes 16, wrap partially around vacuum couch roll 17 then separate. Wire 10 passes around rolls 18, tensioning roll 19 and guide roll 28 before returning to forming roll 12. Wire 11 continues over couch roll 17 then passes over tensioning roll 20, roll 21 and guide roll 22 before returning to breast roll 13. The jet stream of pulp 23 from the slice outlet 24 of head box 25 is directed substantially tangent to breast roll 13 and impinges on forming wire 10 just before it converges with wire 11 then passes, between the two wires, through the dewatering zone comprising deflector blades 15, suction boxes 16 and vacuum couch roll 17. The partially dewatered web of paper 23' is held on wire 11 through the action of the vacuum couch roll and is removed at pick-off roll 30.

FIG. 2 shows an enlarged view of the jet stream of pulp 23 issuing from the slice outlet 24 and impinging on outer wire 12 at point P. Due to the fact that the slice outlet is a narrow opening which extends across the entire width of the sheet of pulp, which may be over 20 feet wide, and without a supporting web structure, the slice must necessarily have a massive, rigid construction. This prevents it from being extended between rolls 12 and 13 and into the converging zone of the two wires 10 and 11 to reduce the distance from the outlet 24 to the point of impingement P.

Figure 3:
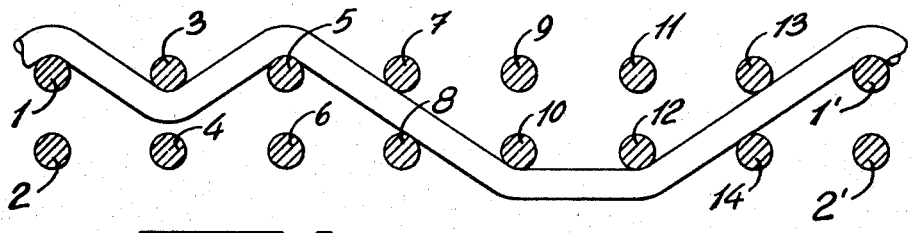
FIG. 3 (PRIOR ART)
FIG. 3 is an enlarged sectional side view of a portion of 7-shed double-layer fabric of the prior art.

In FIG. 3 there is shown an example of 7-shed, 14 repeat two-layer fabric of the prior art such as in U.S. Pat. No. 4,071,050. The numbered weft strands are paired and each warp strand interweaves with the weft strands as shown and repeats after the 14th weft strand. Consecutive warp strands each follow the same weaving pattern but do not necessarily commence their weaving pattern over successive pairs of weft strands.

Figure 4:
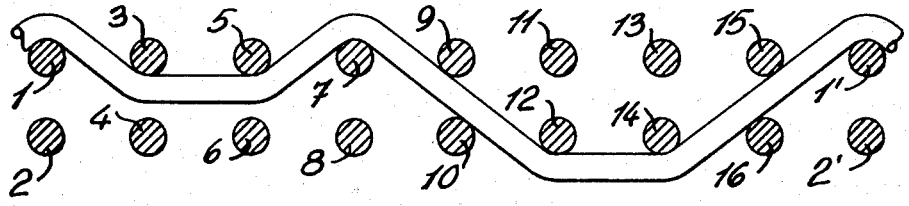
FIG. 4 (PRIOR ART)
FIG. 4 is a similar view of a portion of 8-shed double-layer fabric of the prior art.

FIG. 4 shows an example of 8-shed, 16 repeat two layer fabric also of the prior art.

Figure 5:
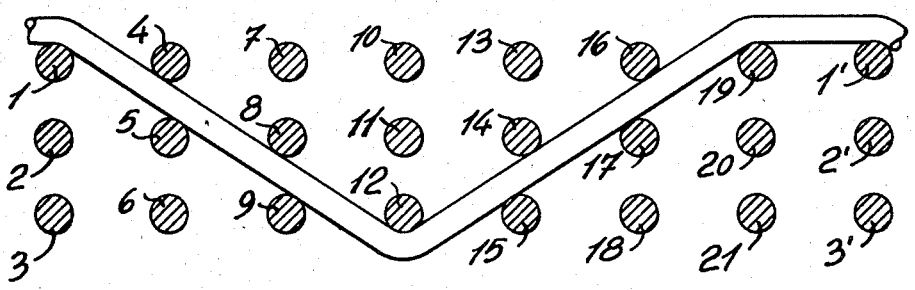
FIG. 5 is an enlarged sectional side view of a portion of 6-shed three-layer fabric of the invention.

In FIG. 5 there is shown an example of 6-shed, 18 repeat three layer fabric of the present invention. The numbered weft strands are arranged in vertically aligned groups of three and each warp strand interweaves with the weft strands as shown and repeats after the 18th weft strand. Consecutive warp strands each follow the same weaving pattern but do not necessarily commence their weaving pattern over successive groups of weft strands.

Figure 6:
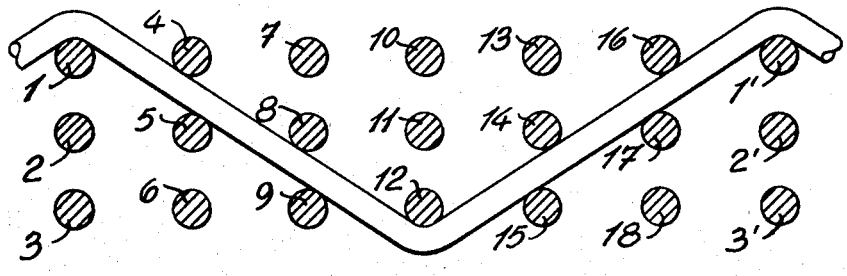
FIG. 6 is a similar view of 7-shed three-layer fabric of the invention.
Figure 7:
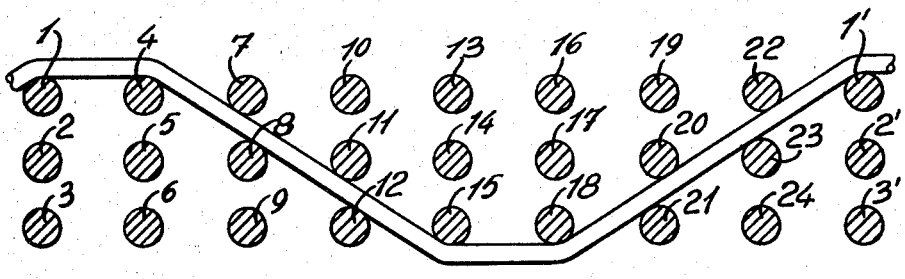
FIG. 7 is a similar view of 8-shed three-layer fabric of the invention.
Figure 8:
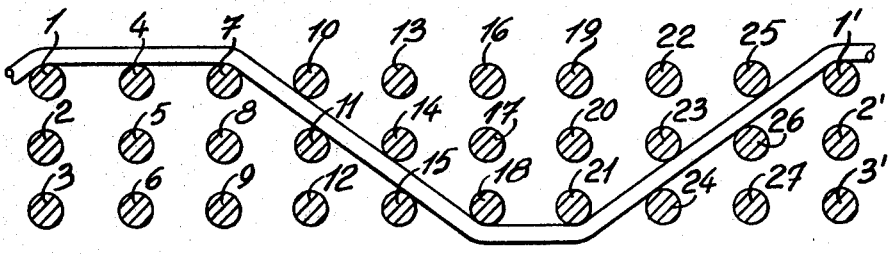
FIG. 8 is a similar view of 9-shed three-layer fabric of the invention.

FIGS. 6, 7 and 8 show examples of three layer fabric of the present invention in 7-shed 21 repeat; 8-shed, 24 repeat and 9-shed, 27 repeat weaving patterns respectively. In each case the weft strands are numbered and arranged in vertically aligned groups of three and the warp strands interweave with the weft strands as shown. It is also within the scope of the invention to weave any three-layer pattern employing up to and including 10 sheds.

The warp counts of the fabric of the invention will range from 80 to 200 per inch and the weft counts in the upper, pulp contacting, surface will be greater than about 40 per inch.

The fabric of the invention will have an air permeability greater than 400 cu.ft./min.sq.ft. as measured at ½ inch of water pressure with a Frasier Air Permeometer.

The fabric of the invention may be used in any location on a paper making machine where increased cross-machine stiffness is required.

It is within the ambit of the present invention to cover any obvious modifications of the embodiment described herein, provided such modifications fall within the scope of the appended claims.

I claim:

1. A single-ply forming fabric comprising an endless belt having opposed side edges, said forming fabric having a lateral direction extending between the side edges thereof and a longitudinal direction extending perpendicular to said lateral direction, said forming fabric being a backing fabric for use in combination with a conveying fabric with which it converges on a twin-wire paper making machine wherein a flat jet-stream of pulp is injected between said conveying backing and conveying fabrics for applying opposed pressure to said pulp for removing water therefrom to form a sheet of paper, said single-ply forming fabric having a plurality of monofilament polymeric warp strands extending in the longitudinal direction and interwoven, with approximately 100% warp fill, with monofilament polymeric weft strands extending in the lateral direction, said weft strands disposed in vertically aligned groups of at least three to obtain greater stiffness in the lateral direction whereby to substantially re-distribute pulp laterally when it is sandwiched between said fabrics.

2. The forming fabric of claim 1 wherein said forming fabric has a warp count in the range of from about 80 to 200 per inch and the weft count in the pulp contacting surface of said forming fabric is greater than about 40 per inch.

3. The forming fabric of claim 2 wherein said forming fabric is woven in a 7-shed weaving pattern.

4. The forming fabric of claim 2 wherein said forming fabric is woven in an 8-shed weaving pattern.

5. The forming fabric of claim 1 wherein said forming fabric has an air permeability greater than 400 cu.ft./min.sq.ft. as measured with a Frasier Air Permeometer.

6. The forming fabric of claim 5 wherein said forming fabric has a stiffness value in the cross-machine direction greater than 20 gms. as measured with a Gurley Stiffness Tester.

* * * * *